US007683250B2

(12) United States Patent
Ikeya et al.

(10) Patent No.: US 7,683,250 B2
(45) Date of Patent: Mar. 23, 2010

(54) ELECTRONIC MUSICAL APPARATUS

(75) Inventors: Tadahiko Ikeya, Hamamatsu (JP); Motonori Sunako, Hamamatsu (JP)

(73) Assignee: Yamaha Corporation (JP)

( * ) Notice: Subject to any disclaimer, the term of this patent is extended or adjusted under 35 U.S.C. 154(b) by 414 days.

(21) Appl. No.: 11/245,613

(22) Filed: Oct. 7, 2005

(65) Prior Publication Data

US 2006/0075882 A1 Apr. 13, 2006

(30) Foreign Application Priority Data

Oct. 8, 2004 (JP) ..... 2004-296962

(51) Int. Cl.
*G10H 1/00* (2006.01)

(52) U.S. Cl. ..... 84/609; 84/615; 84/649

(58) Field of Classification Search ..... 84/609, 84/615, 649, 653
See application file for complete search history.

(56) References Cited

U.S. PATENT DOCUMENTS

| | | | | |
|---|---|---|---|---|
| 2,153,027 | A * | 4/1939 | King | 84/470 R |
| 3,955,466 | A * | 5/1976 | Goldmark | 84/470 R |
| 5,439,382 | A * | 8/1995 | Pettinichi | 434/319 |
| 6,506,967 | B1 * | 1/2003 | Calello | 84/470 R |
| 7,129,407 | B2 | 10/2006 | Hiratsuka et al. | |

FOREIGN PATENT DOCUMENTS

| | | | |
|---|---|---|---|
| JP | 61-176991 | A | 8/1986 |
| JP | 62-187397 | A | 8/1987 |
| JP | 6-118867 | A | 4/1994 |
| JP | 10-301568 | A | 11/1998 |
| JP | 2003-223165 | A | 8/2003 |
| JP | 2004-264392 | A | 9/2004 |

OTHER PUBLICATIONS

Cakewalk Pro Audio 9, User's Guide (1999. Twelve Tone Systems). pp. 3-11, 3-12, 3-14, 6-2,6-3, 8-2,8-3.*
Portatone EZ-J53, Yamaha User Manual; pp. 35, 38-44.
Portatone EZ-J53, Yamaha User Manual in Japanese; pp. 35-44. English Translation provided for pp. 35, 38-41.
Notification of Reasons for Refusal issued in corresponding Japanese patent application No. 2004-296962, dated Nov. 4, 2008.
Decision of Refusal issued in corresponding Japanese patent application No. 2004-296962, dated Feb. 3, 2009.

* cited by examiner

*Primary Examiner*—David S. Warren
(74) *Attorney, Agent, or Firm*—Rossi, Kimms & McDowell LLP

(57) ABSTRACT

An electronic musical instrument is configured to store music data including performance data on a plurality of tracks and receive designation of a track or tracks so that when a test-listen button for receiving instruction of test-listen of the designated track(s) is pressed, the electronic musical instrument plays the performance data on the designated track(s) among the music data and plays the performance data on the other tracks at a volume lower than the volume of the designated track(s).

9 Claims, 4 Drawing Sheets

ELECTRONIC MUSICAL APPARATUS

BACKGROUND OF THE INVENTION

1. Field of the Invention

The present invention relates to an electronic musical apparatus having a function of playing music data including performance data on a plurality of tracks.

2. Description of the Related Art

An electronic musical instrument such as a keyboard or the like has conventionally been known which has a function of playing music data including performance data on a plurality of tracks. Further, in the electronic musical instrument having such a function, when a user presses a practice switch (lesson button), the instrument plays performance data on tracks relating to parts other than the part designated as a lesson part, while the instrument, for the track relating to the lesson part, instead of playing its performance data, instructs a key to be hit on a keyboard by turning on its lamp or the like or displays contents to be played as a score based on the performance data.

Such electronic musical instruments are described, for example, in user's manual of "PORTATONE EZ-J53 (trade name)" available from YAMAHA CORPORATION, pp. 35 to 44 and in Japanese Publication of Patent Application No. 2003-223165 (JP 2003-223165, A).

Besides, for music data for use in a keyboard musical instrument such as an automatic piano, performance data for right hand (for melody) and performance data for left hand (for accompaniment) are separately stored so that these data are accessible separately, thereby allowing test-listen of only the right-hand or left-hand performance part prior to performance lesson. Such technology is described in JP Japanese Publication of Patent Application No. 6-118867 (JP 6-118867, A).

SUMMARY OF THE INVENTION

Incidentally, in the electronic musical apparatus, there has also been a demand for test-listen of performance contents relating to a designated track. The demand is, for example, that for lesson of music, the user wants to listen to a model of a part that the user begins to play and then start playing the part, or the like.

However, in the electronic musical instruments described in Japanese user's manual of "PORTATONE EZ-J153 (trade name)" or in JP 2003-223165, A, it is only possible to switch ON/OFF for each track, bringing about a problem. The problem is that all of tracks other than the track relating to the part that the user wants to play need to be set to OFF for test-listen described above, leading to troublesome setting and requiring long time.

On the other hand, in the keyboard described in JP 6-118867, A, the user can test-listen to performance based on one of the performance data for the right hand and for the left hand. However, since distinction is made only for the performance data for the right hand and the left hand, there is a problem of the instrument being incapable of coping with the case in which three or more tracks are provided. Another problem is that the instrument cannot cope with commercially available music data in which tracks are not separated into that relating to the right-hand part and that relating to the left-hand part.

It is an object of the invention to solve the above problem to make it possible to easily test-listen, in an electronic musical apparatus, performance based on performance data relating to a designated track of music data including performance data on a plurality of tracks.

To attain the above object, the electronic musical apparatus of the invention includes a memory for storing music data including performance data on a plurality of tracks; a designating device that designates one track or a plurality of tracks; a control for receiving instruction of test-listen of the track designated by the designating device; and a player for, upon the instruction of test-listen, playing the performance data on the track designated by the designating device among the music data, and playing the performance data on another track at a volume lower than the volume of the designated track.

It is preferable that the electronic musical apparatus described above further includes a score display for displaying a score based on contents of the music data, wherein the score display is configured to display a score based on the performance data on the track designated by the designating device when the player plays the music data.

Further, it is also preferable that the apparatus includes a key display for displaying a key on a keyboard to be hit, wherein the key display is configured to display a key to be hit for performance of a part related to the performance data in concert with play of the performance data on the track designated by the designating device when the player plays the music data.

Further, the invention also provides an electronic musical apparatus, including a memory for storing music data including performance data on a plurality of tracks; a designating device that designates one track or a plurality of tracks; a first control for receiving instruction of test-listen of the track designated by the designating device; and a second control for receiving instruction of play of track other than the track designated by the designating device; a first player for, upon the instruction of test-listen, playing the performance data on the track designated by the designating device among the music data, and not playing the performance data on other track or playing the data at a volume lower than the volume of the designated track; and a second player for, upon the instruction of play, playing the performance data on a track not designated by the designating device among the music data, and not playing the performance data on the track designated by the designating device or playing the data at a volume lower than the volume of the not-designated track, wherein the first control and the second control are provided at positions close to each other on a control panel.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, preferred embodiments for carrying out the invention will be concretely described with reference to the drawings.

Figure 1:
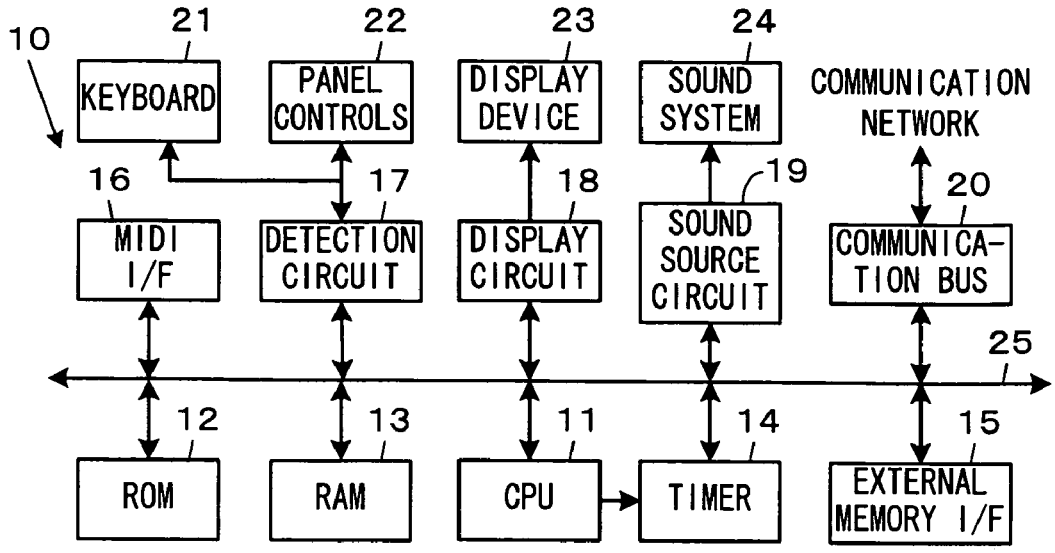
FIG. 1 is a block diagram showing a configuration of an electronic musical instrument being an embodiment of an electronic musical apparatus of the invention.

A configuration of an electronic musical instrument being an embodiment of an electronic musical apparatus of the invention will be described first using FIG. 1. FIG. 1 is a block diagram showing the configuration of the electronic musical instrument.

As shown in FIG. 1, an electronic musical instrument 10 includes a CPU 11, a ROM 12, a RAM 13, a timer 14, an external memory interface (I/F) 15, a MIDI (Musical Instruments Digital Interface) I/F 16, a detection circuit 17, a display circuit 18, a sound source circuit 19, and a communication I/F 20, which are connected by a communication bus 25. The electronic musical instrument 10 further includes a keyboard 21 and panel controls 22 connected to the detection circuit 17, a display device 23 connected to the display circuit 18, and a sound system 24 connected to the sound source circuit 19.

The CPU 11, which is a controller that comprehensively controls the whole electronic musical instrument 10, can execute required control programs stored in the ROM 12, the external memory I/F 15, or so on to control actions of the components of the electronic musical instrument 10, thereby realizing various functions including a function related to characteristics of the embodiment of the invention described below.

The ROM 12 is a non-volatile memory that stores data which require no change.

Figure 2:
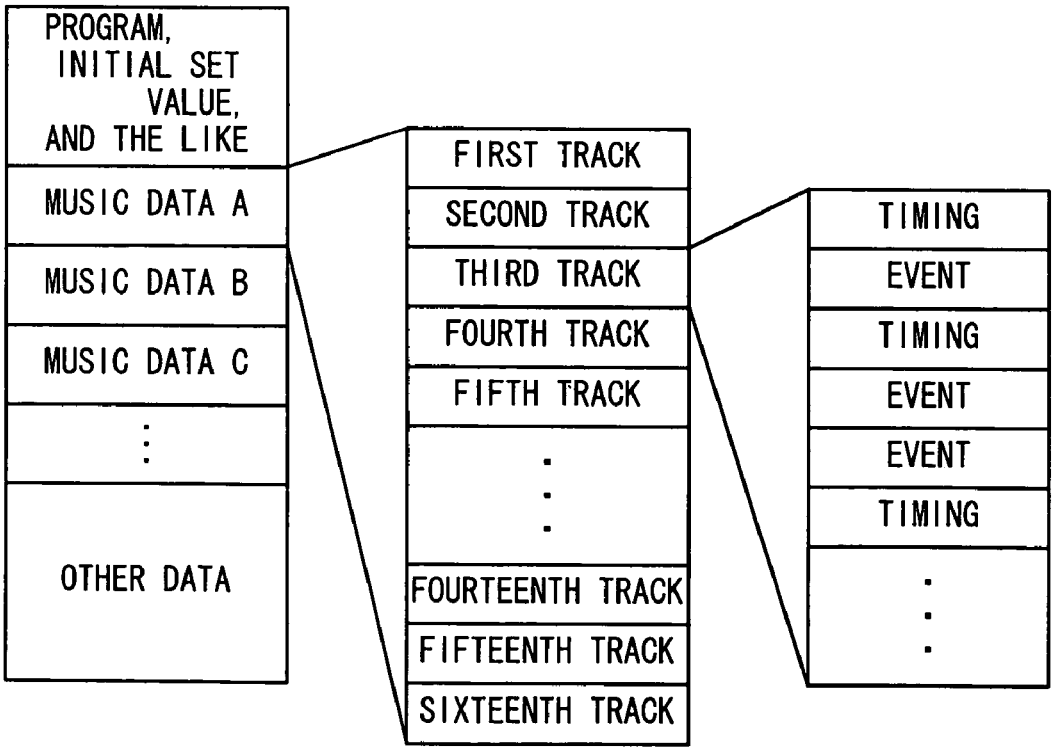
FIG. 2 is an illustration showing a configuration of data to be stored in a ROM in the electronic musical instrument shown in FIG. 1.

The configuration of data to be stored in the ROM 12 is now shown in FIG. 2.

As shown in this drawing, the ROM 12 is configured to store the control program executed by the CPU 11, initial set values of the electronic musical instrument 10, music data, and so on.

Among them, the control program is for the CPU 11 to control the electronic musical instrument 10 for realization of the various functions, and the initial set values are data such as tempo data, tone color data, volume data, music name data, and the like, which are used to determine general sound-generation contents and display contents in carrying out normal performance, automatic performance, and music data play.

The music data is MIDI data representing the contents of music, each piece of music data including performance data on 16 tracks. For the music data to be stored in advance in the electronic musical instrument 10, a first track is associated with the right hand (melody) part and a second track is associated with the left hand (accompaniment) part. The association of the other tracks with what parts differs according to the music, and it is not always necessary that all of the tracks have data.

The performance data on each track is information presenting play contents of music, that is, information for playing main melody for the track associated with the melody part, and information for playing parts other than the melody (chord performance, base performance, rhythm performance, and so on) for the other tracks. These kinds of information include a combination of timing data and event data which are arranged in the order of play progression.

Among them, the timing data is data representing timing (time) when processing related to the event represented by the event data associated therewith should be performed, and a plurality of events may be associated with one timing. The event data is data representing contents of various kinds of events for playing music, including a note-on event, a pitch change event, a note-off event, a tempo change event, a tone color change event, and so on.

The ROM 12 storing the above-described data may be composed of a rewritable non-volatile memory to allow addition or updating of data. Alternatively, it is also applicable that the music data is not stored in the ROM 12, but all the music data to be played may be read from a later-described memory or an external device.

Returning to description of FIG. 1, the RAM 13 is a memory that is used as a work area of the CPU 11, temporarily stores music data to be played, stores values of parameters to be temporarily used, and so on.

The timer 14, which is a time keeping module, is used for timing control of processing related to the events of note-on, note-off, and so on according to a designated tempo when performance of music is carried out based on the music data.

The external memory I/F 15 is a module for reading and writing data from/into an external memory, such as a flexible disk drive (FDD), a memory card slot, or the like. In the electronic musical instrument 10, it is also possible to carry out performance based on the music data read from the memory by the external memory I/F 15.

The MIDI I/F 16, which is an interface for passing data in conformity with MIDI standards, is used for communicating with another electronic musical instrument compatible with MIDI, a computer including an application program handling MIDI data, or the like.

The detection circuit 17 is a detector for detecting the contents of operation performed through the keyboard 21 and panel controls 22, and transmitting them to the CPU 11. The keyboard 21 is used when the user plays the electronic musical instrument 10, while the panel controls 22 are controls such as buttons, encoders, and the like provided on a control panel of the electronic musical instrument 10, which are used for the user to perform various setting operations and operation instructions.

The display circuit 18 is a display controller for controlling display on the display device 23 according to the instruction from the CPU 11. The display device 23 is a display including a liquid crystal display (LCD), a light emitting diode (LED), or the like provided on the control panel, and displays a message, score, keyboard, ON/OFF state of each button, and so on. The keyboard 21 is provided with lamps for hit guide, the lamps also included in the display device 23.

The sound source circuit 19 is a sound source for generating waveform data in a plurality of channels based on the performance data on the tracks constituting the music data and transmitting the data to the sound system 24 including speakers and so on to generate sound to play the music data. In this case, it is also possible to use only the performance data on a part of the tracks among the music data, and play the music based on only the part of the performance data. It is also possible to play the music data on conditions (volume, tone color, and the like) different for each track. It is, of course, possible to cause the sound system 24 to output sound of a designated tone color in response to operation on the keyboard 21 by the user.

The communication I/F 20 is an interface for performing communication of Ethernet (registered trademark) system or IEEE (Institute of Electrical and Electronic Engineers) 1394 system, through which the electronic musical instrument 10 can be connected to a communication network. Then, through the communication network, music data can also be downloaded from an external device and played.

The electronic musical instrument 10 can thus realize the following functions using the above-described components.

First of all, the electronic musical instrument 10 can generate and output musical sound according to key operation (hit) on the keyboard 21 by the user. The electronic musical instrument 10 can also semi-automatically or automatically generate accompaniment sound and rhythm sound corresponding to the accompaniment style and rhythm pattern designated through the panel controls 22. The electronic musical instrument 10 can also carry out automatic performance based on the music data designated by the user, in which case ON/OFF of performance can be designated for each track in the music data. Furthermore, the electronic musical instrument 10 also includes a guide function for assisting play by the user, when performing automatic performance, by causing the LCD to display a score based on the music data in use for the automatic performance, or by turning on the lamp for a key at a timing when the key should be hit based on the performance data of the designated part.

Next, the configuration of the control panel of the above-described electronic musical instrument 10 will be described.

Figure 3:
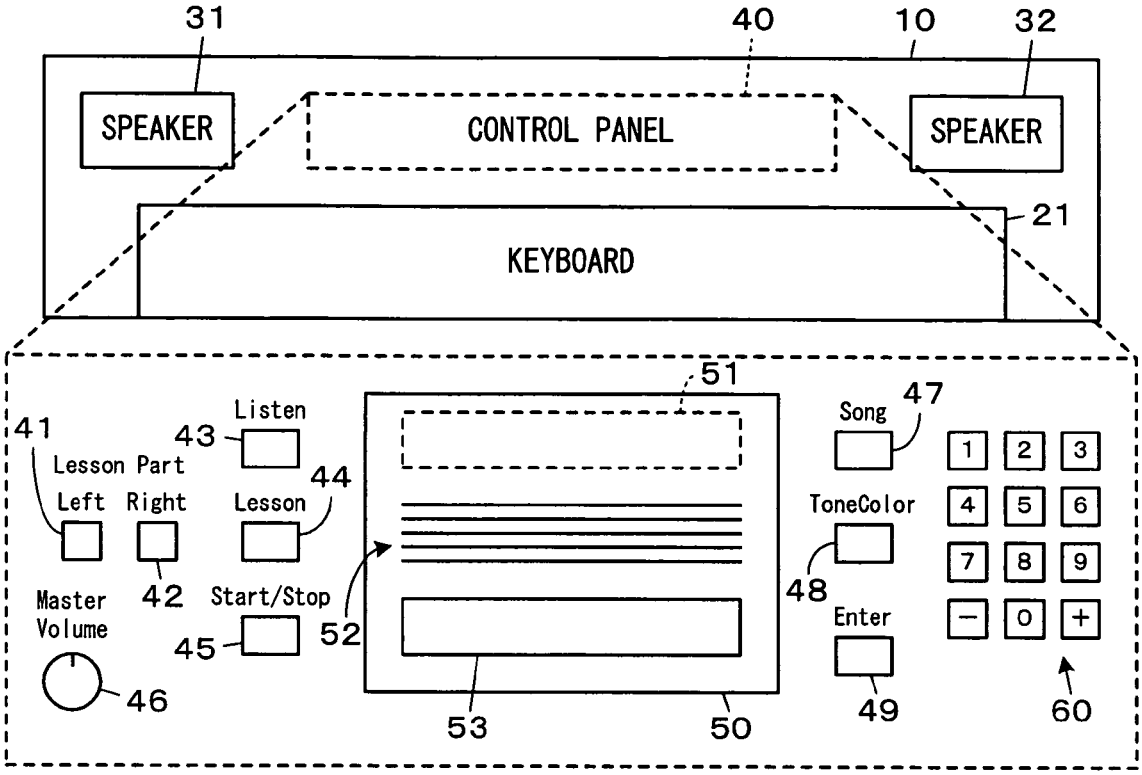
FIG. 3 is a view for explaining a configuration of a control panel of the same.

The configuration of the control panel is shown in FIG. 3.

In FIG. 3, a schematic plane view of the electronic musical instrument 10 is shown on the upper side. As is clear from the drawing, in the electronic musical instrument 10, the keyboard 21 for performance is provided on front side of the upper face, and speakers 31 and 32 for outputting sound (corresponding to the sound system 24) are provided on the right and left sides on the back side. Further, a control panel 40 is provided at the central portion on the back side as shown by a broken line, which includes controls for the user to perform various setting operations and operation instructions and a display panel for displaying a message, score, and so on. Further, a more detailed plane view of the control panel 40 is shown in a part surrounded by a broken line on the lower side in FIG. 3.

As can be seen from the drawing, the control panel 40 is provided with a left-hand button 41, a right-hand button 42, a test-listen button 43, a lesson button 44, a start/stop button 45, a master volume 46, a song designation button 47, a tone color designation button 48, an enter button 49, an LCD 50, and a ten-key 60.

The left-hand button 41 is a button for designating the left-hand part of music as a lesson part. The button is configured such that its press allows ON/OFF designation to be switched by toggle. The left-hand button 41 is provided with a lamp implemented by an LED, which is turned on when the left-hand part is designated as the lesson part or turned off when it is not designated, so that the user can easily recognize the state of the ON/OFF designation.

It should be noted that although the track to be associated with the left-hand part is fixed to the second track for the music data previously stored in the electronic musical instrument 10, for use of other music data an arbitrary track can be associated with the left-hand part by operating the ten-key 60 while pressing the left-hand button 41.

On the other hand, the right-hand button 42 is a button for designating the right-hand part of music as the lesson part and configured such that its ON/OFF designation can be switched by toggle independently from the left-hand part. In addition, the right-hand button 42 is configured, similarly to the left-hand button 41, such that its ON/OFF state can be displayed by a lamp and it can be associated with a track. Accordingly, in combination with the left-hand button 41, only the left-hand part, only the right-hand part, or both of them can be designated as the lesson part(s). This designation can be arbitrarily changed even during automatic performance.

The test-listen button 43 is a button which is a first control, for instructing, play of (the track associated with) a part designated as the lesson part for test-listen. When this button is pressed, the electronic musical instrument 10 plays the performance data on the track associated with the lesson part as well as plays the performance data on the other tracks at a volume lower than that of the track associated with the lesson part. Such play shall be referred to as play of a "test-listen mode." If the test-listen button 43 is pressed again during play, the play is stopped.

On the other hand, the lesson button 44 is a button which is a second control, for instructing play of parts other than (the track associated with) a part designated as the lesson part for lesson of the part. When this button is pressed, the electronic musical instrument 10 plays the performance data on the tracks not associated with the lesson part. Such play shall be referred to as play of a "lesson mode." If the lesson button 44 is pressed again during play, the play is stopped.

The test-listen button 43 and the lesson button 44 are provided at positions close to each other by adjacently placing them on the control panel 40.

The start/stop button 45 is a button for instructing start/stop of normal automatic performance (operation of playing the data on all of the tracks at the same volume), and pressing this button during play of the test-listen mode or the lesson mode can instruct also stop of the play.

The master volume 46 is a control for relatively adjusting the volume of play of the music data and sound generation in response to hit of a key. The volume actually generated by the electronic musical instrument 10 is adjusted by the master volume 46 while the relation of magnitude of volume determined by the volume adjustment for each track according to the above-described mode, the velocity in the sound generation event, and the like, are being maintained. It is also conceivable to provided, in addition to the master volume 46, controls for adjusting the volumes of the right-hand part and the left-hand part.

The song designation button 47 is a button for designating music data of music for lesson or automatic performance, configured such that a press of this button followed by input of the number for the music data through the ten-key 60 can designate the music data. It is also possible to designate the music data stored in the memory attached to the external memory I/F 15 or in the external device on the communication network and read the data into the RAM 13.

The tone color designation button 48 is a button for designating the tone color for use in sound generation in response to hit of a key or in automatic performance, configured such that a press of this button followed by input of the number for the tone color through the ten-key can designate the tone color. The tone colors include those of piano, violin, and so on.

The enter button 49 is a button for deciding an input of a number, when the ten-key 60 is used to input the number.

The LCD 50 is a display unit which displays various images, characters, and so on and includes a character display section 51, a score display section 52, and a keyboard display section 53 within its display screen. The character display section 51 displays operation contents or setting contents of the electronic musical instrument 10 such as the name of music data to be played or a tone color in use, the set operation mode, and so on, or messages and so on to the user. The score display section 52 displays, as a score, the contents of the music during automatic performance or a part of that music designated as the lesson part. Depending on the contents of the music or the part, it is also conceivable to use staff notation in a plurality of staves or use a score other than that in staff notation. The keyboard display section 53 displays the image of a keyboard and displays, in a reverse display or the like, a key or keys to be hit for playing the music during automatic performance or the part of the music designated as the lesson part.

The ten-key 60 composed of number keys of 0 to 9 and an increase key (+) and a decrease key (−) is used for inputting numbers.

The functions of the above-described controls and display sections are realized by the CPU 11 executing the required control program to perform processing in accordance with the operation contents on the controls detected by the detection circuit 17. This embodiment is characterized in that the test-listen button 43 is provided so that when an instruction is issued through the button, the music data can be played in the test-listen mode, and that the test-listen button 43 is provided adjacent to the lesson button 44 to allow the test-listen mode or the lesson mode to be selected with excellent operability.

Next, processing executed by the CPU 11 for realizing these functions will be described. Note that description of other processing for realizing general functions will be omitted.

First of all, for play in the test-listen mode or the lesson mode, it is necessary to designate the music data to be played, and the lesson part. Further, the tracks to be associated with the left-hand part and the right-hand part can be changed from their default states.

The CPU 11 is configured such that when operations listed on the left column in Table 1 are detected, the CPU 11 executes processing listed on the respective right boxes as the processing related to the aforementioned designation and change.

TABLE 1

| Contents of detected operation | Contents of processing to be executed |
|---|---|
| Music data number is inputted after press of song designation button | Read music data of inputted number from ROM or the like and write the data into RAM and cause LCD to display name of the music data |
| Left-hand part button and/or right-hand part button are/is pressed | Designate part(s) corresponding to pressed button(s) as lesson part(s) and release the designation by toggle, record its contents in RAM, and control turning on/off of lamp(s) provided at button(s) according to designation state of lesson part(s) |
| Track number is inputted while left-hand part button or right-hand part button is being pressed | Associate track of inputted track number with part corresponding to pressed button, and change data of the corresponding track number stored in RAM |

These kinds of processing allow designation of the music data and lesson part and association of tracks with respective parts. It is also possible to store the music data to be played in the RAM 13 so as to read the data at an arbitrary timing. Further, the designation of the lesson part and association of tracks with the right-hand part and the left-hand part allows designation of tracks which are handled, as a lesson object, differently from the other tracks. In these kinds of processing, the CPU 11 functions as a designating device.

Note that it is also conceivable to read the music data from the memory attached to the external memory I/F 15 or from an external device with which communication can be established via the communication I/F 20. As for the music data previously stored in the ROM 12, the first track has been associated with the right-hand part and the second track has been associated with the left-hand part, and therefore when previously stored music data is designated, the association of tracks may be automatically changed as described above to inhibit change of the association.

Figure 4:
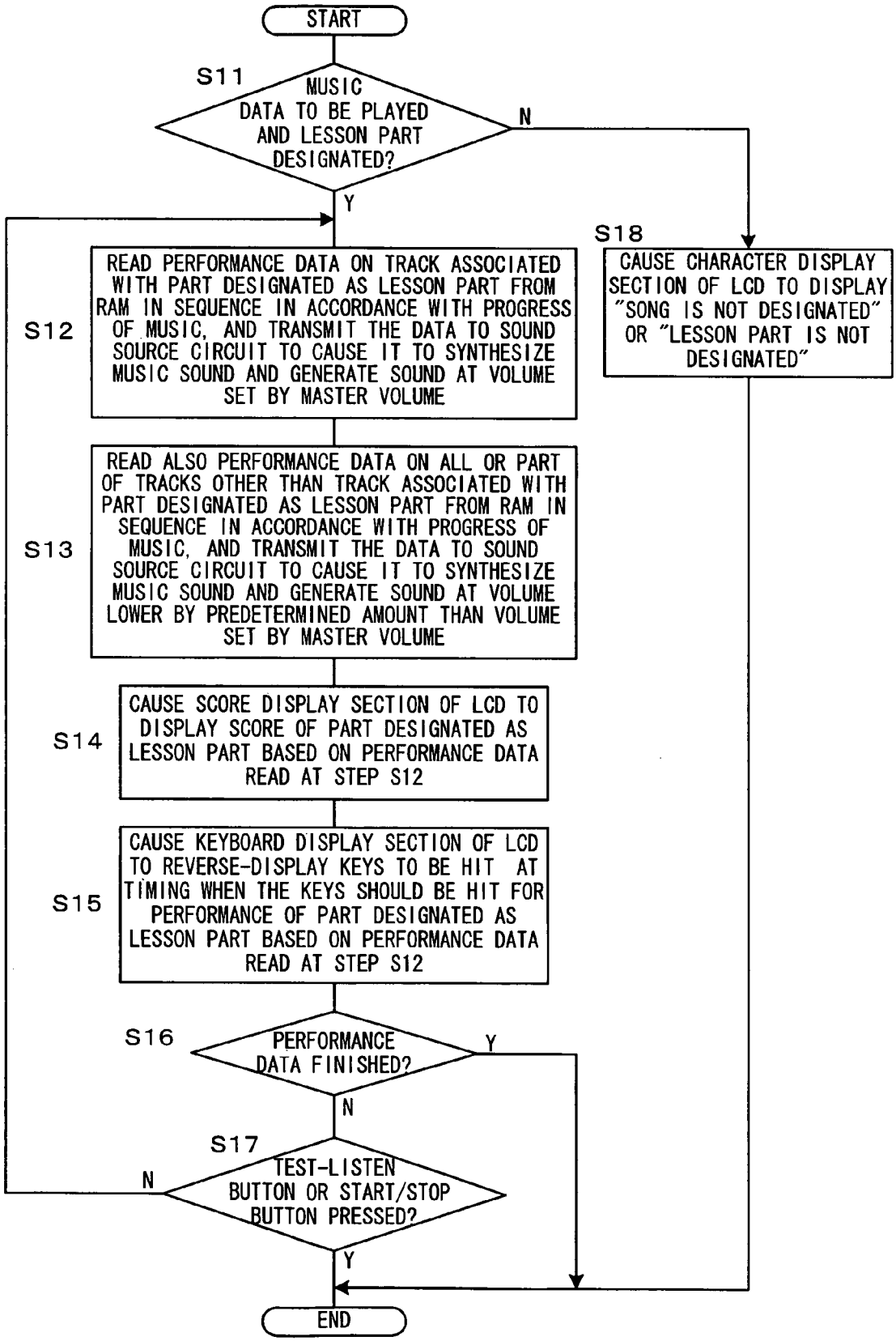
FIG. 4 is a flowchart of processing executed by a CPU of the electronic musical instrument shown in FIG. 1 upon detection of a press of a test-listen button.

Next, a flowchart of processing executed by the CPU 11 when the test-listen button 43 is pressed is shown in FIG. 4. This processing is processing related to play of music data in the test-listen mode.

Upon detection of a press of the test-listen button 43, the CPU 11 starts the processing shown in the flowchart in FIG. 4. If music data to be played and a lesson part are designated, the CPU 11 proceeds from Step S11 to Step S12 and steps subsequent thereto. The CPU 11 then plays the performance data on the track associated with the lesson part among the music data to be played at a volume set by the master volume 46 as well as plays the performance data on the other tracks at a volume lower by a predetermined amount (for example, 20 decibels) than that of the track associated with the lesson part (S12, S13).

In this case, the performance data is played on the basis that the volume lower by the predetermined amount than the volume set by the master volume 46 is set for "the other tracks." Accordingly, depending on the contents of the performance data, there may be a portion thereof which is generated more loudly than the track associated with the lesson part.

Alternatively, only the performance data on a particular track of "the other tracks," for example, a track of the rhythm part may be played at a volume set by the master volume 46 similarly to the lesson part. This makes it easy to catch the timing of hitting keys of the lesson part in the flow of rhythm, resulting in more effective test-listen.

It is preferable that the aforementioned "predetermined amount" can be freely changed by the user. Further, it is also conceivable to bring the volume to 0 for "the other tracks," which means no play thereof. It is also suitable to make the tempo of performance conform to the designated contents included in the music data or conform to the contents designated by the user.

Since the designation of the lesson part is changeable any time even during performance, it is preferable to confirm the designated contents stored in the RAM 13 every time the processing in the steps S12 and S13 is performed.

In the processing in these Steps S12 and S13, the CPU 11 functions as a first player.

In addition to play of the music data, the CPU 11 further performs processing to cause the score display section 52 of the LCD 50 to display the score of the lesson part, and processing to cause the keyboard display section 53 to reverse-display a key or keys to be hit at a timing when the keys should be hit for performance of the lesson part (S14, S15).

In the processing in these steps S14 and S15, the CPU 11 and the LCD 50 function as a score display and a key display.

Thereafter, the CPU 11 repeats the processing by returning to Step S12 until the performance data is finished or the test-listen button 43 or the start/stop button 45 is pressed, and finishes the processing when the performance data is finished or when the test-listen button 43 or the start/stop button 45 is pressed (S16, S17).

Besides, when the music data or the lesson part is not designated in Step S11, the CPU 11 causes the character display section(s) of the LCD 50 to display a message showing the fact (S18), and then finishes the processing.

The performance of the above processing allows the user to test-listen to the contents of a part that the user wants to practice, in distinction from the other parts, only by pressing the test-listen button 43, so that the user can easily grasp the contents of the part that the user wants to practice by a simple operation. Further, since the user can listen to the other parts at a low volume at the same time, the use can grasp the flow from the start of music to easily grasp the timing to start to play the part that the user wants to practice. Even for a music configuration such that the accompaniment part or rhythm part starts first and the melody part starts thereafter, for example, the user can easily grasp the start timing of the melody part. Therefore, the user can effectively practice playing music.

Further, if the score or keys to be hit is/are displayed for the lesson part, the user can also visually grasp the contents and performance procedure of music and therefore practice playing music more effectively.

Note that it is not always necessary to play all of the tracks other than the track associated with the lesson part at Step S13 in the processing shown in FIG. 4, but only a part of the tracks corresponding to the accompaniment part, rhythm part, and so on may be played. In this case, the tracks to be played are preferably tracks corresponding to parts including introduction, ending, or the like to present the start or stop timing of music. Besides, which part (or track) is to be played in the test-listen mode may be automatically set or may be freely set by the user.

In the processing shown in Steps S12 to S15, play and display of the score and keys may be performed in an arbitrary order. The score and keys do not always need to be displayed.

It is also conceivable to display keys to be hit by turning on the respective lamps provided at the keys on the keyboard 21 instead of the LCD 50. In this case, the lamps and the CPU 11 function as the key display.

Figure 5:
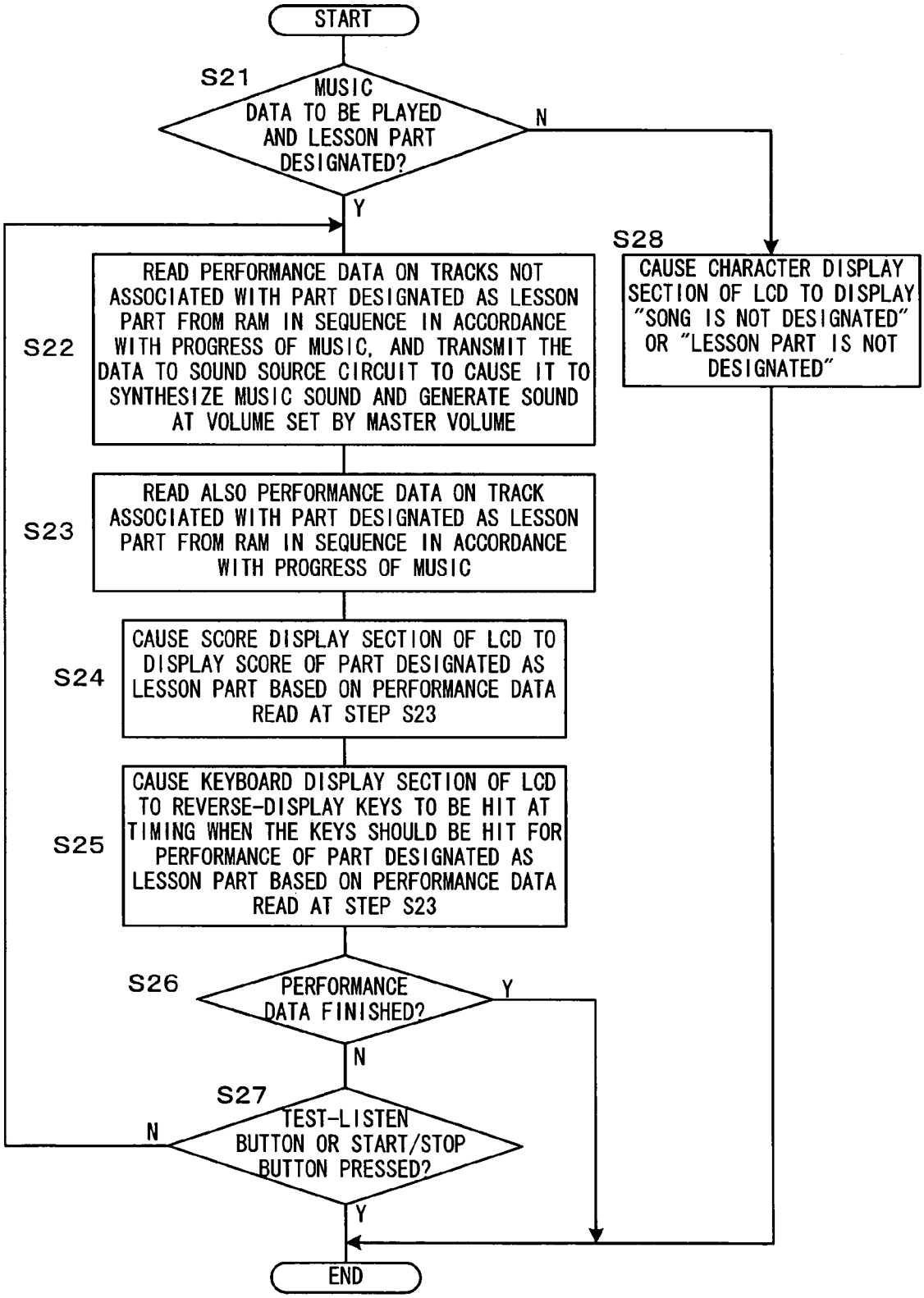
FIG. 5 is a flowchart of processing executed by the same upon detection of a press of a lesson button.

Next, a flowchart of processing executed by the CPU 11 when the lesson button 44 is pressed is shown in FIG. 5. This processing is processing related to play of the music data in the lesson mode.

Upon detection of a press of the lesson button 44, the CPU 11 starts the processing shown in the flowchart in FIG. 5. If music data to be played and a lesson part are designated, the CPU 11 proceeds from Step S21 to Step S22 and steps subsequent thereto. The CPU 11 then plays the performance data on the tracks of the music data to be played other than the track associated with the lesson part at a volume designated by the master volume 46. In the processing in Step S22, the CPU 11 functions as a second player.

In addition to play of the music data, the CPU 11 further reads the performance data on the track associated with the lesson part and performs, based on the data, and performs processing to cause the LCD 50 to display the score and a key or keys to be hit as in Steps S14 and S15 in FIG. 4 (S23 to S25).

Thereafter, the CPU 11 repeats the processing by returning to Step S22 until the performance data is finished or the lesson button 44 or the start/stop button 45 is pressed, and finishes the processing when the performance data is finished or when the lesson button 44 or the start/stop button 45 is pressed (S26, S27).

Besides, when the music data or the lesson part is not designated in Step S21, the CPU 11 causes the character display section 51 of the LCD 50 to display a message showing the fact (S28), and then finishes the processing.

In the processing shown in Steps S22 to S25 of the above-described processing, play and display of the score and keys may be performed in an arbitrary order and the score and keys do not always need to be displayed, as in the case in FIG. 4.

The performance of the above processing allows the user to instruct the electronic musical instrument 10 to play the parts other than the part that the user wants to practice only by pressing the lesson button 44, so that the user can practice the part that the user wants to practice on the keyboard 21 in concert with the play to thereby effectively practice the part, measuring the timing of performance. In the processing shown in FIG. 5, the CPU 11 may play the performance data on the track associated with the lesson part at a volume lower by a predetermine amount than that of the tracks not associated with the lesson part, as in the case of Step S13 in FIG. 4. This makes it possible to use the played sound as a guide when the user plays the part that the user wants to practice, resulting in more effective practice.

Since the test-listen button 43 for instructing play in the test-listen mode and the lesson button 44 for instructing play in the lesson mode are provided at positions close to each other on the control panel 40 in the electronic musical instrument 10 which has been described, these modes can be easily switched by a single operation to play music. Accordingly, the user can listen to the part that the user wants to practice and then practice playing the part in concert with the other parts by a simple operation.

Although the example in which the lesson part is selected from among the right-hand part and the left-hand part is described in the above-described embodiment, a part other than the above parts, such as a part of the percussion or the like can be designated as the lesson part. If the track including performance data related to the percussion or the like is associated with the right-hand part or the left-hand part, such a function can be realized within the above-described processing.

Further, when the lesson button 44 is pressed during play in the test-listen mode, the processing shown in FIG. 4 may be immediately switched to the processing shown in FIG. 5 to allow the play to be continued in the practice mode form the point during the play of music. Alternatively, the play in the test-listen mode may be stopped so that play in the lesson mode may be started from the beginning. Conversely, when the test-listen button 43 is pressed during play in the lesson mode, play in the test-listen mode may be performed similarly to the above.

Besides, the function of playing in the lesson mode does not always need to be provided in the above-described electronic musical instrument.

Furthermore, as for points other than the above, the configuration of the apparatus, the kinds and arrangement of the buttons provided on the control panel, the method of operating them, the configuration of the display screen and display form, or the like is, of course, not limited to the above-describe one.

For example, controls provided on a GUI (Graphical User Interface) may be used as the controls for operation instructions and setting, including the test-listen button and the lesson button.

The electronic musical apparatus may be configured as a personal computer (PC), a computer game machine, a karaoke (sing-along) machine, or the like, by mounting performance controls such as a keyboard or the like, a sound source, a sound system or the like thereon or by connecting with them as external devices to make them usable. The processing related to each of the above-described functions and the function of the performance controls and sound source may be realized by hardware or by software.

Further, although the operation of playing the music data is called the test-listen mode or the lesson mode in the above-described embodiment, the purpose of using these modes is not limited to test-listen or lesson.

As has been described, according to the electronic musical apparatus of the invention, it is possible to easily test-listen performance based on performance data related to a designated track of music data including performance data on a plurality of tracks. Therefore, according to the invention, an electronic musical apparatus can be provided which is suitable for lesson of performance.

What is claimed is:

1. An electronic musical apparatus comprising:

a plurality of part selecting controls;

a memory for storing music data comprising performance data on a plurality of tracks;

an assigning device that assigns an arbitrary track among the plurality of tracks to each of the plurality of part selecting controls according to an instruction by a user a designating device configured to designate, according to an operation on the plurality of the part selecting controls, at least one track among tracks assigned to the part selecting controls;

a control configured to receive an instruction to initiate a test-listen mode of the at least one designated track; and a controller configured to, when the control receives the instruction to initiate the test listen mode, start playing the music data in the test-listen mode, where the at least one designated track is played at a designated volume, while all of or some of at least one remaining track other than the at least one designated track among the tracks assigned to the part selecting controls is played at a volume lower than the designated volume of the designated track but higher than zero, to enable the at least one designated track to be emphasized.

2. The electronic musical apparatus according to claim 1, further including a display for displaying a score based on the performance data of the at least one designated track when the controller plays the music data.

3. The electronic musical apparatus according to claim 2, wherein the display further displays keys of a keyboard to be manually played for performance of a part related to the at least one designated track in concert with play of the performance data of the at least one designated track when the controller plays the music data.

4. The electronic musical apparatus according to claim 1, further including a display for displaying keys of a keyboard to be manually played for performance of a part related to the at least one designated track in concert with play of the performance data of the at least one designated track when the controller plays the music data.

5. The electronic musical apparatus according to claim 1, wherein:

the plurality of tracks of the musical data include a track of a rhythm part, and when the controller plays the music data in the test-listen mode, the controller plays the track of the rhythm part at the same volume as the designated volume of the at least one designated track.

6. An electronic musical apparatus comprising:

a plurality of part selecting controls;

a memory for storing music data comprising performance data on a plurality of tracks;

an assigning device that assigns an arbitrary track among the plurality of tracks to each of the plurality of part selecting controls according to an instruction by a user;

a designating device configured to designate, according to an operation on the plurality of the part selecting controls, at least one track among the tracks assigned to the part selecting controls;

a control panel having at least a first control and a second control, wherein the first control is configured to receive an instruction to initiate a test-listen mode of the at least one designated track, wherein the second control is configured to receive an instruction to initiate a play mode with at least one track among the tracks other than the at least one designated track; and a controller configured to:

when the first control receives instruction to initiate the test-listen mode, start playing the music data in the test-listen mode, where the at least one designated track is played at a first designated volume, while all of or some of at least one remaining track other than the at least one designated track among the tracks assigned to the part selecting controls is not played or played at a volume lower than the first designated volume of the at least one designated track but higher than zero, and when the second control receives instruction to initiate the play mode, start playing the music data in the play mode, where the at least one remaining track other than the at least one designated track is played at a second designated volume, while the at least one designated track is not played or played at a volume lower than the second designated volume of the at least one remaining track other than the at least one designated track.

7. The electronic musical apparatus according to claim 6, wherein:

the plurality of tracks of the musical data include a track of a rhythm part, and when the controller plays the music data in the test-listen mode, the controller plays the track of the rhythm part at the same volume as the first designated volume of the at least one designated track.

8. A machine-readable storage medium storing a computer program executable by a computer for controlling an electronic musical apparatus having a memory for storing music data comprising performance data on a plurality of tracks and having a plurality of part selecting controls, the computer program comprising:

an assigning code for assigning an arbitrary track among the plurality of tracks to each of the plurality of part selecting controls according to an instruction by a user;

a designating code for designating, according to an operation on the plurality of the part selecting controls, at least one track among the tracks assigned to the part selecting controls;

a receiving code for receiving an instruction to initiate a test-listen mode of the at least one designated track, a controlling code for:

when the receiving code is executed to receive the instruction to initiate the test-listen mode, start playing the music data in the test-listen mode, where the at least one designated track is played at a designated volume, while all or some of the at least one remaining track other than the at least one designated track among the tracks assigned to the part selecting controls is played at a volume lower than the designated volume of the at least one designated track but higher than zero.

9. The machine-readable storage medium according to claim 8, wherein:

the plurality of tracks of the musical data include a track of a rhythm part, and when the controlling code is executed to play the music data in the test-listen mode, the controlling code plays the track of the rhythm part at the same volume as the designated volume of the at least one designated track.

* * * * *